United States Patent [19]

Irvine et al.

[11] 3,970,298

[45] July 20, 1976

[54] MIXED THICKNESS SHEET SEPARATOR AND FEEDER

[75] Inventors: Robert Irvine, Riverside; L. Neil Kanning, Darien, both of Conn.

[73] Assignee: Pitney-Bowes, Inc., Stamford, Conn.

[22] Filed: June 5, 1975

[21] Appl. No.: 584,002

[52] U.S. Cl. ..... 271/34; 271/122

[51] Int. Cl.[2] ..... B65H 3/04

[58] Field of Search ..... 271/34, 35, 10, 122, 271/125, 119, 274, 6, 7; 214/8.5 G

[56] References Cited

UNITED STATES PATENTS

| | | | |
|---|---|---|---|
| 652,821 | 7/1900 | Vail et al. | 271/34 X |
| 1,058,696 | 4/1913 | Boswell | 271/34 |
| 1,955,066 | 4/1934 | Hiller | 271/35 |
| 2,852,255 | 9/1958 | Fischer | 271/35 X |
| 3,771,783 | 11/1973 | McInerny | 271/125 |

*Primary Examiner*—John J. Love
*Assistant Examiner*—Bruce H. Stoner, Jr.
*Attorney, Agent, or Firm*—William D. Soltow, Jr.; Albert W. Scribner; Robert S. Salzman

[57] ABSTRACT

A sheet separating device for mechanically feeding single sheets from a magazine having a stack of intermixed sheets of different thicknesses. The apparatus includes a conveyor assembly having an endless belt provided with integral feed pads for successively contacting and transporting sheets from the stack. A feed limiting barrier directs movement of the sheets toward a pair of discharge rollers which rotate in a direction for advancing the movement of the sheets. A separator roller mounted in confronting, overlapping relationship with the discharge rollers rotates in a direction opposing forward movement of the sheets to prevent passage of more than one sheet between the separator and discharge rollers. The conveyor assembly is spring-biased and swingably displaceable with respect to the separator roller for variable clearance in order to accommodate sheets of different thicknesses. Additionally, the discharge rollers are urged into contact with idler rollers to automatically compensate for wear. A sheet limit stop spaces the sheets with regard to the belt and feed pads in order to relieve intersheet pressure and to minimize the adhesion between adjacent sheets during engagement by the feed pads.

1 Claim, 5 Drawing Figures

MIXED THICKNESS SHEET SEPARATOR AND FEEDER

BACKGROUND OF THE INVENTION

1. Field of the Invention

This invention relates generally to an article handling apparatus and more particularly to a mechanism for separating and transporting sheets in a vertical orientation and for the synchronous delivery of single sheets in seriatim.

The apparatus of this invention is additionally concerned with a sheet feeding device compatible for use with high speed mail handling systems and especially adaptable for accommodating and processing a plurality of intermixed pieces of mail having various sizes and thicknesses.

2. Description of the Prior Art

Many of the prior art paper transport and feeding assemblies are designed for conveying uniform thickness sheets, data cards, blanks, coupons, documents or other similar materials and conventionally provide for the removal of sheets from either the top or bottom of a horizontally oriented stack as typically shown in U.S. Pat. No. 2,852,255.

Other known devices, such as those suitable for separation of pieces of mail having different thicknesses, generally utilize a resiliently movable separator or stripper which is either manually adjustable or otherwise yieldable with respect to a fixedly mounted conveyor to thereby provide compensation for the various sheet thicknesses. Such a device is shown, for example, in U.S. Pat. No. 1,955,066.

A disadvantage of these prior devices is that they do not effectively overcome the problems caused by adhesion of adjacent sheets particularly at high speed delivery. These previously known mail handling apparatus therefore do not provide uniform and consistent single sheet feeding. This is due in part to the ineffectiveness of the yieldable separator arrangements which are not reliable in preventing binding or feeding of multiple sheets especially when processing intermixed materials having a wide range of sizes and thicknesses.

The mixed thickness paper feeder of this invention overcomes the disadvantages of these previously known apparatus and incorporates an improved structure having a pivotally mounted endless belt conveyor for cooperative interaction with a separator rotatably driven on a shaft journaled within a fixed mounting. The conveyor is yieldably displaceable in response to a force exerted by the transported materials and is automatically compensating to provide the necessary clearance for more effectively accommodating a wide range of mixed thickness materials. The spring biasing of the conveyor additionally serves as a wear compensation feature.

Another advantage of the instant invention is the elimination of sticking of adjacently stacked materials or of a shingling effect during transportation of the materials. This is achieved in part by stacking the materials on edge, the use of a feed limiting barrier, and further by the employment of a sheet limit stop which relieves intersheet pressure and thereby reduces the compressive take-up force during the wiping contact and removal of the individual sheets from the pack.

BRIEF SUMMARY OF THE INVENTION

Briefly, the invention relates to a sheet separator and feeder arrangement adapted to separate and successively feed single sheets from a stack of intermixed sheets of different thicknesses.

The basic components of the apparatus of this invention include a conveyor assembly, a magazine supply holder, a feed limiting barrier and a separator roller. The magazine supply holder is adapted to be loaded with a plurality of heterogeneous size and thickness sheets, vertically stacked for transport on edge over a horizontal surface. The sheets are transported by the conveyor assembly which has a pivotally mounted frame structure for supporting an upstream drive gear and a downstream idler gear. The drive gear propels a pair of parallel spaced endless belts carried on said gears. The belts, in turn, each have integral projections or feed pads in registry which contact the sheets in the magazine. The downstream movement of the sheets, as initiated and advanced by the feed pads, is guided by the feed limiting barrier toward a pair of spaced discharge rollers on the downsteam idler gear. The discharge rollers are rotatably driven in a forward direction for ejecting the sheets. The separator roller is driven in a reverse direction to the discharge rollers and interacts with the discharge rollers to reject passage therebetween of more than one sheet. The necessary clearance between the discharge rollers and separator roller for various thickness materials is adjusted automatically by the swingable displacement of the conveyor assembly about the axis of the upstream drive gear. The displacement is a result of the pressure exerted by the feed pads pushing the sheets into the limiting barrier which exerts a force for displacing the conveyor assembly. This counterforce will act against a compression spring force which urges the discharge rollers toward the separator roller.

The compression spring is also effective in maintaining contact between the discharge rollers and idler rollers to thereby compensate for discharge roller wear.

To further prevent possible adhesion or sticking as the sheets are transported, a sheet limit stop is attached to the conveyor frame and extends between the belts opposite the magazine supply holder. The limit stop spaces the sheets in a horizontally offset position with respect to the belts to prevent contact with the belts. Additionally, by so spacing the sheets the feed pads can tangentially engage the sheets as they move around the drive gear with minimum wiping contact pressure. This will inherently reduce the intersheet frictional force and adhesion between adjacent sheets.

Having thus summarized the invention, it will be seen that an object thereof is to provide an improved sheet separating and feeding device of the general character described herein which is not subject to the disadvantages of the prior art.

Specifically, it is an object of this invention to provide a sheet separating and feeding device for high speed feeding of single sheets from a stack of sheets having a wide range of thicknesses.

Another object of this invention is to provide a sheet separating and feeding device wherein the sheets are separated from a heterogeneous mixed stack by a conveyor assembly having an endless belt with feed pads thereon for engaging and moving a single sheet from the stack.

A further object of this invention is to provide a sheet separating and feeding device which minimizes the tendency for adjacent sheets in the pack from adhering by reducing the contact pressure between the feed pads and the sheets.

Still another object of this invention is to provide a sheet separating and feeding device which is self-adjusting to accommodate different thickness sheets and has a pivotal conveyor assembly which is swingably displaceable to accommodate different sheet thicknesses.

A still further object of this invention is to provide a sheet separating and feeding device with automatic wear compensating features.

Other objects of the invention in part will be obvious and in part will be pointed out hereinafter.

With these ends in view, the invention finds embodiment in certain combinations of elements and arrangements of parts by which the said objects and certain other objects are hereinafter attained, all as fully described with reference to the accompanying drawings and the scope of which is more particularly pointed out and indicated in the appended claims.

BRIEF DESCRIPTION OF THE DRAWINGS

In the accompanying drawings in which is shown a preferred embodiment of the invention.

DETAILED DESCRIPTION OF THE INVENTION

Figure 1:
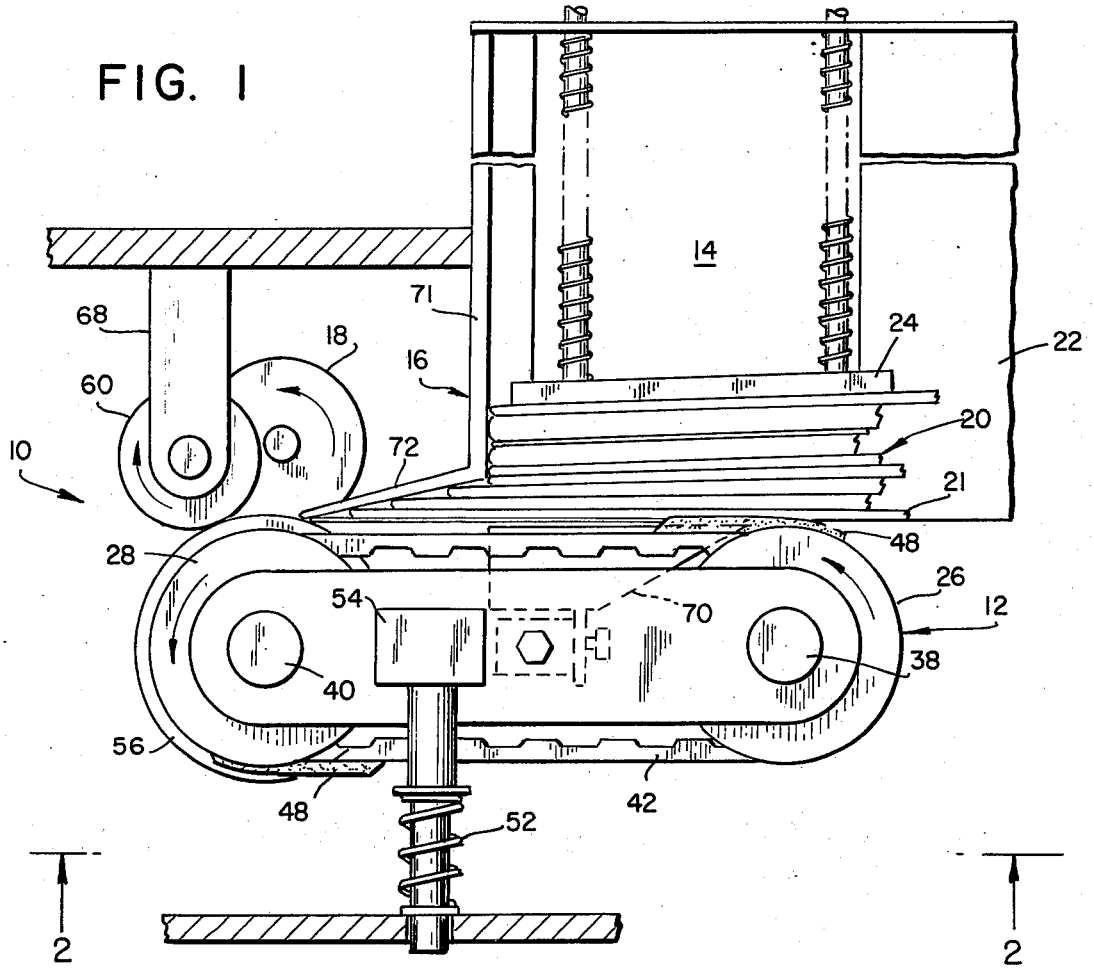
FIG. 1 is a top plan view of the sheet separating and feeding apparatus of this invention and illustrating a pivotal conveyor assembly of this invention including a magazine supply holder loaded with edgewise envelopes having different thicknesses and sizes, a feed limiting barrier and a separator roller.
Figure 2:
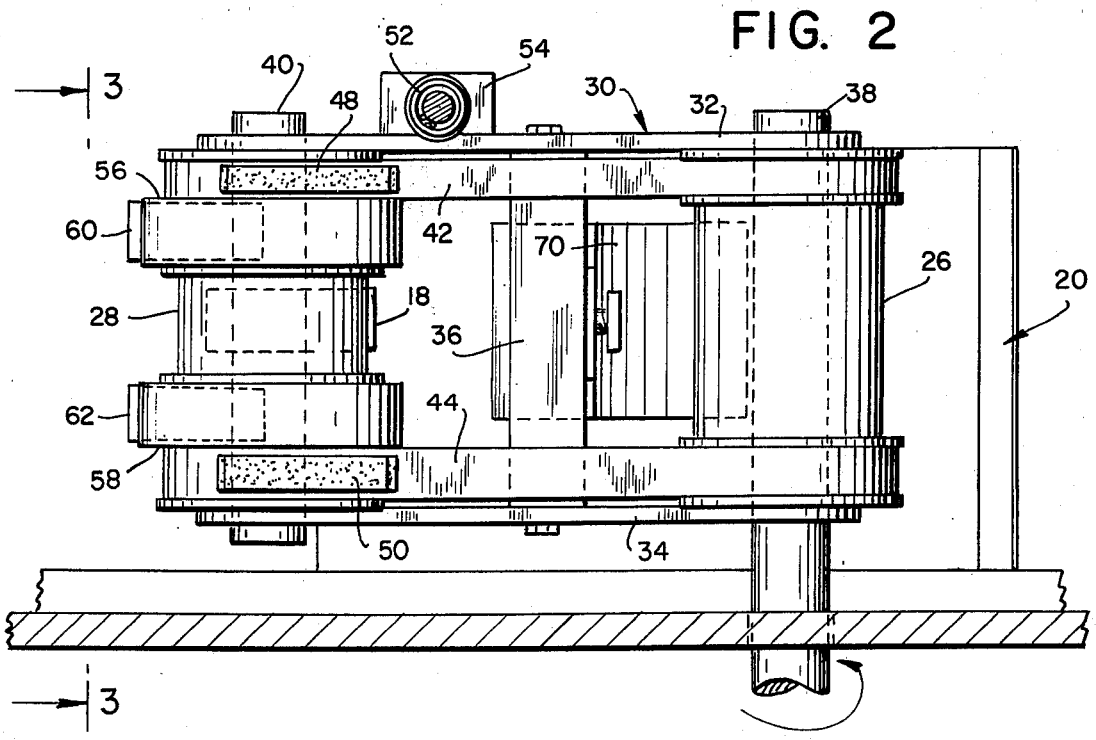
FIG. 2 is a side elevational view taken substantially along line 2—2 of FIG. 1 showing an upstream drive gear, a downstream idler gear having two vertically spaced discharge rollers and two endless belts on the gears including registered feed pads.

Referring now in detail to the drawings, the reference numeral 10 denotes generally the sheet separating and feeding apparatus of this invention. The apparatus 10 includes a conveyor assembly 12, a sheet holding magazine 14, a feed limiting barrier 16, and a separator roller 18. Although the apparatus 10 is designed to accept a wide spectrum of sheet material such as data cards, documents, coupons, blanks, inserts, envelopes, and similar articles, the apparatus 10 will be described with specific reference to mail handling. Accordingly, the magazine supply holder 14, as shown in FIG. 1, is adapted to firmly hold a plurality of mail articles in a vertical orientation, such as mail envelopes 20. The envelopes 20 are stacked by edgewise placement in the magazine 14 for transportation on a horizontal supporting surface or deck 22. A slidable platen 24 is spring biased toward the conveyor assembly 12 and thus positions successive envelopes 20 for contact with the conveyor assembly 12. The apparatus 10 is adaptable for processing and the magazine 14 will accommodate various intermixed dimensional sized mail articles from the very thinnest of air mail envelopes to mail parcles approximating ½ inch in thickness including oversized envelopes commonly known as "slugs".

In accordance with the intended purposes of the invention, the envelopes 20 are transported edgewise on the surface of the deck 22 downstream or in a direction from right to left as in FIG. 1. The conveyor assembly 12 in conjunction with the separator roller 18 and feed limiting barrier 16 effectively segregate the envelopes 20 to provide a sequential output of single envelopes.

The conveyor assembly 12 includes an upstream drive gear 26 and a downstream idler gear 28. The drive gear 26 and idler gear 28 are mounted within a structural frame 30 having side plates 32, 34 and a cross member 36. A drive shaft 38 preferably rotating at a synchronous speed powers the drive gear 26; the idler gear 28 rotates freely about a shaft 40 which is journaled between side plates 32, 34. Two parallel endless belts 42, 44 have inner surfaces formed with continuous internal teeth which engage the gears 26, 28. The external surface on each of the belts 42, 44 has raised or projected companion feed pads 48, 50, respectively, which are bonded or otherwise incorporated onto the respective belts. Each of the feed pads 48, 50 is in vertical registry and is constructed with a surface having a relatively high coefficient of friction, preferably having $\mu = 1.3$ or higher, to positively feed the envelopes 20.

The frame 30 is pivotally supported from the drive shaft 38. The conveyor assembly 12 is urged toward the separator roller 18 by a compression spring 52 which applies a biasing force against an abutment block 54 projecting vertically from the frame 30. A pair of spaced discharge rollers 56, 58 are affixed to and rotatable with the idler gear 28 and are urged by the spring 52 against a pair of idler rollers 60, 62, each of which turns freely on a shaft 64, 66, respectively, journaled in opposed legs of fixed yoke 68. It should be apparent that any wear on either the discharge rollers 56, 58 or the idler rollers 60, 62 will be automatically compensated for by spring 52. However, the idler rollers 60, 62 are preferably made of steel and therefore do not receive much wear.

A limit stop 70 is attached to the frame 30 and extends from the cross member 36 between belts 42, 44. The limit stop 70 is laterally adjustable to provide an abutment for an envelope 21 next to be discharged. In this manner the envelope 21 can be spaced to avoid contact with the moving belts 42, 44, yet be close enough for tangential wiping contact with feed pads 48, 50 as they travel around the drive gear 26. For optimum operational conditions, the nearest envelope 21 should be spaced such that frictional force with the feed pads 48, 50 will be sufficient to transport the envelope on edge downstream without binding, swerving, wrinkling or otherwise jamming. Furthermore, the lateral pressure exerted by the feed pad 48, 50 into the stack of envelopes 20 should not be so great as to cause or effect an adhering of adjacently positioned envelopes in the stack. In other words, ideally the limit stop 70 should effectively position the nearest envelope 21 such that the frictional force exerted on that envelope 21 by the feed pads 48, 50 will be just greater than the interenvelope frictional force. However, since the size, weight, and thickness of an intermixed stack of envelopes 20 will vary over a wide range of values, optimum conditions cannot always be achieved as heretofore mentioned. For this reason, the feed limiting barrier 16 in the form of a sloped fence is positioned at the downstream leading edge of the stack of envelopes.

The barrier 16 is fixedly mounted and has a straight portion 71 substantially perpendicular to the conveyor assembly 12 and a sloped nose portion 72 forming an angle of approximately 15° with the plane of the belts 42, 44. The nose portion 72 has a cut away section 74 to provide an opening for the separator roller 18.

Figure 3:
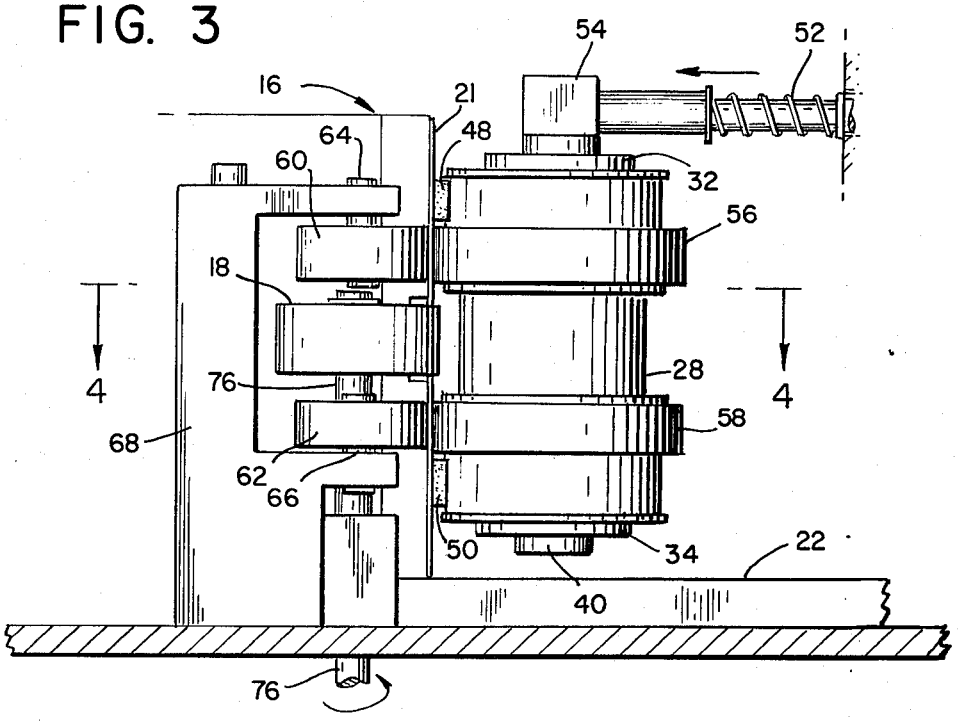
FIG. 3 is an end elevational view taken substantially along line 3—3 of FIG. 2 showing a separator roller interfitting in an overlapping relationship between the two discharge rollers which in turn engage respective idler rollers at a point in time just prior to passage of an envelope between the separator and discharge rollers.
Figure 4:
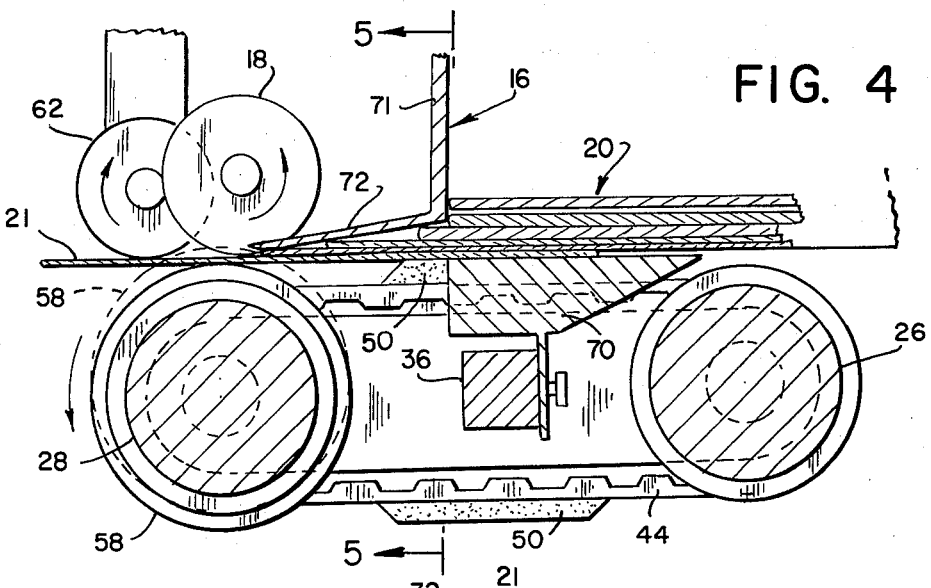
FIG. 4 is a sectional view taken substantially along line 4—4 of FIG. 3 after displacement of the conveyor assembly and discharge rollers wherein the broken line diagrammatically illustrates the previous position of the discharge rollers; additionally included is a limit stop for holding the envelopes in a pressure relief position for wiping contact by the feed pads.

The separator roller 18 is rotatably affixed to a drive shaft 76 adapted to drive the roller 18 in a counterclockwise direction as indicated in FIGS. 1 and 4. As further denoted in FIG. 3, the separator roller 18 is in confronting relationship with and staggered vertically between the idler rollers 60, 62. When the discharge rollers 56, 58 are in contact with the idler rollers 60, 62, the peripheral surface of the separator roller 18 extends between the two discharge rollers 56, 58 such as illustrated in FIG. 3. The peripheral surface of both the discharge rollers 56, 58 and separator roller 18 is preferably surfaced with a material having a high coefficient of friction in the order of $\mu = 0.6$ or that which is generally greater than the coefficient between the stacked materials to be separated.

In operation, intermixed envelopes 20 are stacked within the magazine supply holder 14 between the slidable platen 24 and the adjustable limit stop 70. When the belts 42, 44 are driven in a counterclockwise direction by the drive gear 38, the feed pads 48, 50 contact a confronting envelope 21 as they move tangentially around the drive gear 26 and will frictionally grip and slide the envelope 21 to transport it downstream towards the discharge rollers 56, 58. Inevitably some adjacent envelopes 20 in the stack will also move downstream. As these additional envelopes 20 come into abutting contact with the feed limiting barrier 16, further movement is retarded by the straight portion 71 except for those envelopes which enter into the nose portion 72.

Figure 5:
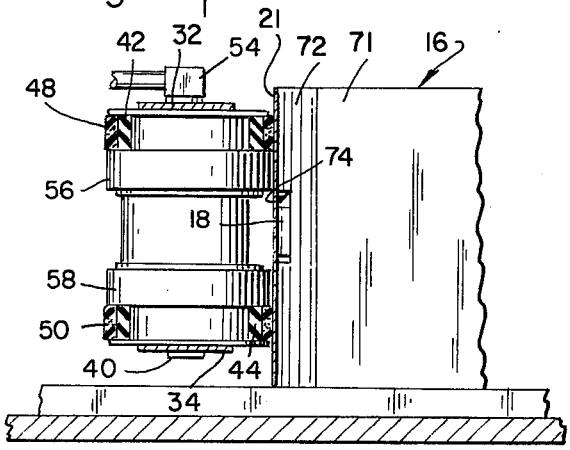
FIG. 5 is a partial sectional view taken substantially along line 5—5 of FIG. 4 and indicates the location of the feed limiting barrier with regard to the feed pads, discharge roller, and separator roller.

The compressive force, which is built up by the feed pads 48, 50 pushing the envelopes 20 into the nose portion 72 is relieved by the movement of the conveyor assembly 12 which is swingably displaceable about the axis of shaft 38 as spring 52 is compressed. The discharge rollers 56, 58 will thereby move away from the separator roller 18 and provide just enough clearance space for accommodating the single envelope 21. From an observation of FIG. 3 the discharge rollers 56, 58 and idler rollers 60, 62 are in contact just prior to this swingable displacement. The movement of discharge rollers 46, 58 is illustrated in FIG. 4 wherein the broken line indicates the initial position of the discharge rollers 46, 48 and the solid line shows the displaced position. It should also be noted that the previously described feed limiting barrier 16 has a cut out section 74 as shown in FIG. 5 whereby the peripheral surface of the separator roller 18 is permitted to contact the adjacent envelopes 20 contiguous to envelope 21 to thereby reject passage of more than one envelope between the separator roller 18 and discharge rollers 56, 58.

The sheet separating and feeding apparatus as described has been successful in feeding sheets at the rate of 500 per minute without having double sheet output, jamming or other malfunctions. It should be obvious, however, that a demand feed system with a slip clutch can be incorporated and that the ouptut as such can be otherwise increased or decreased as required.

Furthermore, it should be understood that the above described embodiment is intended as exemplary only, and while it has described the invention with specific implementation thereof, other modifications and changes might be made to this embodiment as so set forth and will be apparent to those skilled in the art. Additionally, it should be understood that all material shown and described in the accompanying drawings is to be interpreted as illustrative and not in a limiting sense.

Having thus described the invention, it is claimed as new and desired to be secured by Letters Patent:

1. A sheet separator and feeder apparatus suitable for high speed mail handling and mechanical processing of unsorted mail articles comprising magazine feeding means for holding a plurality of mail articles, said magazine means further accommodating a range of different sizes and thicknesses of intermixed envelopes, a conveyor assembly having movable engagement means for frictionally contacting successive envelopes, said conveyor assembly including a drive gear, a spaced apart idler gear, and engagement means including at least one belt disposed between and driven by said gears, said belt having a feed pad integral therewith and projecting from the surface of the belt, said idler gear supporting two spaced apart discharge rollers thereon, two spaced apart idler rollers being in engagement with said discharge rollers, automatic wear compensating means for movably urging said discharge rollers into said engagement with said idler rollers, separator means co-operatively interacting with the conveyor assembly for controlling envelope output delivery by retarding passage of more than one envelope therebetween, said separator means including a separator roller, said separator roller being horizontally offset and vertically staggered between the two discharge rollers with an overlap of the respective peripheral surfaces of the discharge roller and the separator roller, the separator roller being further rotatably driven in reverse direction from the discharge rollers to effectively restrain passage of more than one envelope therebetween, the conveyor assembly being yieldably displaceable with respect to the separator means for accommodating different envelope thicknesses and thereby permitting sequential delivery of single envelopes, and a sheet limit stop, said sheet limit stop extending from the conveyor assembly and contacting the envelopes in the magazine means for spacing said envelopes away from the conveyor belt, whereby interenvelope frictional force is reduced during contact of the envelopes by the engagement means and adhesion between adjacent envelopes is minimized.

* * * * *

UNITED STATES PATENT OFFICE
CERTIFICATE OF CORRECTION

Patent No. 3,970,298 Dated July 20, 1976

Inventor(s) Robert Irvine - Neil L. Kanning

It is certified that error appears in the above-identified patent and that said Letters Patent are hereby corrected as shown below:

Column 3, line 31, after the word "edgewise" please insert -- stacked --.

Column 4, line 11, the word "parcles" should be -- parcels --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*